US011398695B2

(12) United States Patent
Nguyen et al.

(10) Patent No.: US 11,398,695 B2
(45) Date of Patent: Jul. 26, 2022

(54) PLUG CONNECTOR WITH IMPROVED SHIELDING AND METHOD OF PRODUCING THE SAME

(71) Applicant: Robert Bosch GmbH, Stuttgart (DE)

(72) Inventors: Vu Lam Nguyen, Stuttgart (DE); Thorsten Kremer, Gerlingen (DE); Wolfgang Pade, Illingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 16/963,269

(22) PCT Filed: Feb. 26, 2019

(86) PCT No.: PCT/EP2019/054718
§ 371 (c)(1),
(2) Date: Jul. 20, 2020

(87) PCT Pub. No.: WO2019/166426
PCT Pub. Date: Sep. 6, 2019

(65) Prior Publication Data

US 2021/0050684 A1 Feb. 18, 2021

(30) Foreign Application Priority Data

Feb. 28, 2018 (DE) ..... 102018202955.5

(51) Int. Cl.
*H01R 13/03* (2006.01)
*H01R 13/6581* (2011.01)
(Continued)

(52) U.S. Cl.
CPC ..... *H01R 13/03* (2013.01); *H01R 13/6581* (2013.01); *H01R 13/6596* (2013.01);
(Continued)

(58) Field of Classification Search
CPC ..... H01R 13/03; H01R 13/6581; H01R 13/6596; H01R 13/74; H01R 13/648; H01R 13/658; H01R 13/6582
(Continued)

(56) References Cited

U.S. PATENT DOCUMENTS 5,634,822 A * 6/1997 Gunell ..... H01R 24/58 439/668
6,066,001 A 5/2000 Liptak et al.
(Continued)

FOREIGN PATENT DOCUMENTS

CN 106575841 A 4/2017
DE 102008024300 A1 9/2009
(Continued)

OTHER PUBLICATIONS

International Search Report for PCT/EP2019/054718, dated Apr. 9, 2019.

*Primary Examiner* — Abdullah A Riyami
*Assistant Examiner* — Justin M Kratt
(74) *Attorney, Agent, or Firm* — Norton Rose Fulbright US LLP; Gerard Messina

(57) ABSTRACT

A plug connector system is described. The plug connector system includes: a plug connector; a housing on which the plug connector is installed; the housing having an opening having a first inner wall; the plug connector having a sheet-metal shield that projects at least in portions into the opening; a ring being disposed in the opening and, with an outer wall, electrically contacting the first inner wall of the opening; the sheet-metal shield electrically contacting, with a further outer wall of the sheet-metal shield, a second inner wall of the ring.

27 Claims, 5 Drawing Sheets

(51) Int. Cl.

| | |
|---|---|
| ***H01R 13/6596*** | (2011.01) |
| ***H01R 13/74*** | (2006.01) |
| *H01R 13/648* | (2006.01) |
| *H01R 13/658* | (2011.01) |
| *H01R 13/6582* | (2011.01) |

(52) U.S. Cl.
CPC ..... *H01R 13/74* (2013.01); *H01R 13/648* (2013.01); *H01R 13/658* (2013.01); *H01R 13/6582* (2013.01)

(58) Field of Classification Search
USPC ..... 439/607.18, 607.19, 607.28, 607.3
See application file for complete search history.

(56) References Cited

U.S. PATENT DOCUMENTS

| | | | | |
|---|---|---|---|---|
| 6,129,563 | A | 10/2000 | Weidner | |
| 6,206,731 | B1 | 3/2001 | Kuo | |
| 7,588,466 | B2 | 9/2009 | Blasko et al. | |
| 7,857,662 | B2 * | 12/2010 | Gillespie ..... | H01R 13/658 439/607.2 |
| 2009/0264002 | A1 | 10/2009 | Bright et al. | |
| 2010/0079971 | A1 | 4/2010 | Gillespie et al. | |
| 2011/0189888 | A1 | 8/2011 | Rhein | |

FOREIGN PATENT DOCUMENTS

| | | | |
|---|---|---|---|
| DE | 202013006413 | U1 | 10/2014 |
| DE | 112013006207 | T5 | 9/2015 |
| EP | 3163690 | A1 | 5/2017 |
| GB | 2348746 | A | 10/2000 |
| JP | 2008041600 | A | 2/2008 |
| JP | 2013529839 | A | 7/2013 |
| WO | 9819368 | A1 | 5/1998 |

* cited by examiner

PLUG CONNECTOR WITH IMPROVED SHIELDING AND METHOD OF PRODUCING THE SAME

FIELD

The present invention relates to a plug connector system and to a method for manufacturing a plug connector system.

BACKGROUND INFORMATION

Electrical plug connectors, for instance for automotive applications, are available in the related art. A plug connector of this kind can be installed on a housing, for instance, in a shielded fashion, components that are electrically connected to the plug connector being disposed in the interior of the housing. Such components can be, for instance, control device components such as a circuit board having electronic or electrical constituents (ASICs, resistors, capacitors, coils, etc.) disposed thereon, or data processing modules that output large data flows (e.g. more than 100 Mbit/s) via the electrical connection, or high-current terminals, e.g. contacts of an inverter of an electrically operated motor vehicle; currents of more than 10 A or more than 50 A can flow, for example, via such high-current terminals, and voltages of more than 12 V or more than 45 V or more than 100 V can be reached. The combination of plug connector and housing can be referred to as a "plug connector system." It can be necessary to keep an external environment of the housing and of the plug connector as free as possible of electromagnetic radiation from the interior of the housing, or conversely it can be advisable to shield the interior of the housing as much as possible from irradiation of electromagnetic radiation from the external environment.

When the plug connector of the plug connector system is plug-connected to a complementary counterpart plug connector, that assemblage of a housing, plug connector, and counterpart plug connector can be referred to as a "plug connector assemblage."

SUMMARY

In accordance with an example embodiment of the present invention, the housing of a plug connector system is advantageously constituted from a favorable and highly thermally conductive and shielding material, e.g., a metal, for instance aluminum. It can be advantageous to electrically contact a shielding element, for instance a sheet-metal shield of the plug connector, to the, for instance, electrically conductive housing, so as thereby to achieve continuous shielding. It can be advantageous in this context to furnish an electrical contact resistance between the housing and the shielding element which is as low as possible, since large shielding currents can occur.

Aluminum can, however, generally form, on its surface, aluminum oxide that does not have particularly good electrical conductivity. It can therefore be advantageous to use copper, or a material that predominantly encompasses copper, for such a shielding element of the plug connector.

The following problems can occur with an exemplifying material pairing of this kind: on the one hand the poorly conductive aluminum oxide layer of the housing can produce an elevated contact resistance. On the other hand, because of the differing electrochemical standard electrode potentials of aluminum and copper, so-called "contact corrosion" can occur, for example when even a low level of atmospheric humidity is present, at the interface between the housing and the shielding element. This can locally increase the contact resistance. In addition, a soft material such as aluminum can creep when a large pressure is applied to it. These two effects (contact corrosion and creep in response to excessive contact force or point load) can cause a decrease over time in that proportion of the contact surface through which a low contact resistance exists. The contact resistance can therefore undesirably rise.

A need can therefore exist for furnishing a plug connector system that is simple to manufacture, can be manufactured using inexpensive materials, reliably maintains shielding between the housing and a shielding element of the plug connector over a planned service life of the plug connector system, and in which the contact resistance between the housing and the shielding element of the plug connector remains as low as possible over the service life. This need can exist in particular with single-wire shielding.

This need can be met by an example embodiment of the present invention. Advantageous embodiments of the present invention are described herein.

According to a first aspect of the present invention, a plug connector system is provided. In accordance with an example embodiment of the present invention, the plug connector system has:

- a plug connector;
- a housing on which the plug connector is installed or attached or fastened or disposed.

The housing has an opening having a first inner wall, the plug connector having a sheet-metal shield that projects at least in portions into the opening. A ring is disposed in the opening and, with an outer wall, electrically contacts the first inner wall of the opening, the sheet-metal shield electrically contacting, with a further outer wall of the sheet-metal shield, a second inner wall of the ring.

In other words, if an axial direction is defined by a center axis of the opening, what results is then the following sequence of elements when viewed radially externally: firstly the inner wall of the opening, then, adjacently inward, the ring having an outer wall and second inner wall, then, adjacently as an innermost element, a first portion of the sheet-metal shield which, with the further outer wall of the sheet-metal shield, contacts the inner wall of the ring. These three elements (inner wall of the opening, ring, sheet-metal shield) can be disposed, for instance, directly adjacently, e.g. with zero clearance, i.e., in direct, gap-free contact. A particularly large contact area, and thus a particularly low contact resistance, can result therefrom.

Particularly simple installation can thereby advantageously be brought about. With further advantage, a particularly large contact area, and thus a particularly low contact resistance, can thereby be brought about, since the ring, constituting a relatively small and easily fabricated part, can be fabricated substantially more simply and less expensively with high precision in terms of its dimensions. The opening in the housing can thus be fabricated relatively coarsely, i.e., with a relatively large tolerance, for instance, for a diameter of the opening, and/or can be, for instance, very rough on the first inner wall, for instance directly from an injection molding process or from a melt casting method or from a die casting process (e.g., aluminum die casting). Thanks to the disposition of the ring in the opening, on the one hand a good and large contact area with respect to the first inner wall of the opening can be brought about, and at the same time, thanks to more precise tolerances for the ring, it is possible to ensure that the sheet-metal shield always securely and reliably contacts the second inner wall of the ring. Lastly, the ring or the material of the ring can be selected so that contact corrosion does not occur either at its contact surface with the housing or at its contact surface with the sheet-metal shield.

The plug connector can represent, as described above, a kind of external electrical interface for components that are disposed in an interior of the housing.

The plug connector can have, for instance, a plug connector housing and/or a contact pin or contact blade.

The plug connector can initially be embodied as an element separate from the housing, and can be installed on, for instance placed onto or into, the housing only in the course of a manufacturing operation. It can then be, for instance, bolted or riveted on, or adhesively bonded on. The plug connector housing can be configured, for instance, from a plastic, for instance injection-molded from a thermoplastic, for instance from polyamide, polyethylene, polypropylene, or other plastics.

The sheet-metal shield can be embodied in the manner of a crown. In other words, the sheet-metal shield can have a base element from which a plurality of arms can project oppositely from an insertion direction of a counterpart plug connector into or onto the plug connector. The insertion direction can proceed, for instance, parallel to the axial direction. The base element can be embodied in a continuous ring shape. It can constitute a first portion of the sheet-metal shield which protrudes into the opening of the housing. The further outer wall of the sheet-metal shield, which electrically contacts the inner wall of the ring, can belong to the base element. For better and more durable or more reliable contacting, contact points can be embodied, for instance by embossing, on the further outer wall. Upon installation of the plug connector on the housing the sheet-metal shield can be disposed in, for instance pressed into, the ring, for instance, by way of a press fit or by nonpositive or frictional engagement.

The housing can also have a plurality of at least two openings in each of which, for instance, a ring is disposed, and the plug connector has, correspondingly thereto, a corresponding number of (or fewer) sheet-metal shields that each protrude in portions, at least with a first portion, into one of the openings.

The fact that the ring is fastened in the opening by nonpositive or frictional engagement, or the ring being pressed into the opening, advantageously ensures particularly reliable contacting between the ring and housing over the service life, with a large contact area. At the same time, this manner of fastening ensures that any nonconductive surface that might be present, for instance oxide layers or dirt, oil, grease, etc., are broken through, thereby lowering the contact resistance between the ring and the housing. Lastly, penetration of fluid media, e.g. air or oxygen, into the contact point between the ring and the first inner wall of the opening is thereby impeded or prevented, so that the electrical connection permanently has a low resistance.

The advantageous result of the fact that an average first roughness of the outer wall of the ring is equal to less than 1.0 μm, preferably less than 0.5 μm, particularly preferably less than 0.35 μm, and very particularly preferably less than 0.3 μm is that a particularly large contact area, and thus a particularly low contact resistance, is produced between the ring and the first inner surface of the opening. A further advantageous result that can be achieved by way of the smooth surface of the outer wall of the ring thereby created is that a possibly rough(er) first surface of the opening, for instance having an average roughness of more than 10 μm, is, as it were, shaved off or ground down by the first outer wall of the ring, and particularly good contact, and a particularly low contact resistance, are thereby produced. The reason is that when, for instance, the radially inwardly projecting "peaks" of the first inner wall of the opening, which contribute to a high average roughness, become abraded, any surface contamination or any oxide layer then also thereby becomes abraded, and the electrical contact resistance decreases. The low roughness of the outer wall of the ring which is thereby selected furthermore minimizes the risk of damaging or scratching a coating of the first inner wall of the opening which may possibly be present. The ring can thus also be used, for instance, for systems in which a first inner surface has a high-grade coating (e.g., using a noble metal) and must not be scratched. The ring can thus be utilized in modular fashion, and effects of scale with regard to manufacture can occur.

The average roughness is usually referred to using the abbreviation $R_a$.

The advantageous result of the fact that an average second roughness of the second inner wall of the ring is less than 1.0 μm or less than 0.5 μm or less than 0.35 μm or less than 0.3 μm is to decrease the risk of damaging or destroying or scratching a possible coating of the sheet-metal shield. A further result is to produce a smooth contact surface of maximum size between the second inner wall of the ring and the sheet-metal shield, and thus a low electrical contact resistance.

The advantageous result of the fact that an average third roughness of the further outer wall of the sheet-metal shield is less than 1.0 μm or less than 0.5 μm or less than 0.35 μm or less than 0.3 μm is to lower the risk of damaging or destroying or scratching the second inner wall of the ring. A further result is to produce a smooth contact surface of maximum size between the second inner wall of the ring and the sheet-metal shield, and thus a low electrical contact resistance.

Because the further outer wall of the sheet-metal shield has a coating, it is advantageously possible to permanently minimize the electrical contact resistance of the sheet-metal shield and/or to protect the sheet-metal shield from corrosion, for instance as a consequence of exposure to air. The insertion force can also be reduced. It is also advantageously possible, depending on the coating, for the surface to be hardened as compared with the surface of the uncoated sheet-metal shield. A coating of this kind can be embodied, for instance, in multiple plies. This advantageously makes possible particularly good adhesion of the outermost layer onto the sheet-metal shield (and/or onto the ring) by the fact that one or several plies of material that can serve, for instance, as adhesion promoters is/are applied between the outermost layer and the sheet-metal shield material (and/or ring material). A difference in standard electrode potential between the sheet-metal shield material and the outermost layer or the ring, and then also with respect to the housing, can thereby also be decreased gradually, which lowers the risk of contact corrosion.

For example, the coating can encompass, for instance predominantly, a material that is selected from the group: silver, gold, platinum, palladium, nickel, tin. For example, the coating can encompass, considered from inside to outside, firstly nickel (directly on the sheet-metal shield or on the ring), and then (facing outward) silver, i.e. applied onto the nickel.

Provision can also be made in principle, alternatively or additionally, that an inner surface and/or an outer surface of the ring has a coating. This also makes it possible, with a suitable coating sequence, to decrease the difference in standard electrode potentials between the ring material and the outer and/or inner contact partners.

Particularly simple, inexpensive manufacturing is enabled, and particularly good shielding in the region of the opening is ensured, by the fact that the first inner wall of the opening encompasses or predominantly encompasses aluminum.

For example, the predominant portion of the housing can be produced from aluminum or from alloys having aluminum, or can predominantly encompass aluminum.

The advantageous result of the fact that the first inner wall of the opening exhibits, before installation of the ring, an average fourth roughness that is more than 10 μm, or is between 10 μm and 50 μm, or is between 15 μm and 30 μm, is that the housing can be used directly after manufacture without further processing, for example directly after injection molding or melt casting or die casting of the housing. Because no further processing then needs to be necessary performed, the housing can thus be manufactured particularly inexpensively. Thanks to the arrangement of the ring in the opening, a layer having poor electrical conductivity which may possibly be present on the surface of the first inner wall can advantageously be shaved off or abraded particularly effectively or at a particularly large number of locations. After the ring is placed in (or pressed into) the opening, a large contact area is then present which does not have any electrically insulating layers (e.g. oxide or dirt). The probability of such an abrasion process at least at some points is greatly increased because of the high roughness. At the same time, the ring thus does not need to exhibit high roughness on its outer wall and does not need to scratch the surface of a smooth first inner surface. The ring can thus also be used, for instance, for systems in which a first inner surface has a high-grade coating (e.g., using a noble metal) and must not be scratched.

Particularly simple and inexpensive manufacture of the plug connector or of the sheet-metal shield is made possible by the fact that that portion of the sheet-metal shield which projects into the opening of the housing encompasses or predominantly encompasses copper. Copper (or an alloy of copper) furthermore has particularly good electrical conductivity and thus particularly low electrical resistance. Copper furthermore has particularly good thermal conductivity. Even large shielding currents can thus be dissipated without difficulty with no occurrence of excessive heating of the shielding.

The risk of contact corrosion is advantageously decreased by the fact that the ring is constituted from a material that has a standard electrode potential that is between the standard electrode potential of the first inner wall of the opening of the housing and the standard electrode potential of that portion of the sheet-metal shield, in particular having no coating, which projects into the opening. In other words, the risk of an increase over time in the contact resistance between the housing, or the first inner wall of the opening, and the sheet-metal shield can thereby be reduced. Especially with a material pairing of aluminum (housing) and copper (sheet-metal shield), the durability of the shielding can be considerably increased by the interposition of the ring.

Particularly inexpensive manufacture is made possible by the fact that the ring is constituted from steel or stainless steel, or the ring predominantly encompasses steel or stainless steel. Stainless steel or steel has a standard electrode potential that is, for instance, between that of aluminum and that of copper, or between aluminum and silver. Stainless steel or steel can furthermore be manufactured without corrosion, so that corrosion of the ring as such can be suppressed even in a context of high relative humidity. Lastly, steel or stainless steel is a relatively hard material, so that a ring produced in that manner can be permanently introduced into the opening, e.g., using a pressing operation, without difficulty. The opening of the housing can also, for instance, have relatively wide tolerances in terms of its inside diameter; thanks to the hard material of the ring, the latter can have, for instance, an outside diameter that is larger than or equal to the largest first inside diameter (within a production tolerance band) of the opening. If the housing then encompasses material that is relative soft compared with the ring, the ring can always be securely and fixedly disposed or installed or fastened in the opening, for instance using a pressing-in operation.

According to a second aspect of the present invention, a method for manufacturing a plug connector system is provided. An example method in accordance with the present invention includes the following steps:

- furnishing a housing having an opening that has a first inner wall;
- furnishing a ring having an outer wall and a second inner wall;
- disposing the ring in the opening in such a way that the ring, with its outer wall, electrically contacts the first inner wall of the opening;
- furnishing a plug connector having a sheet-metal shield, the sheet-metal shield having a further outer wall;
- disposing the plug connector on or in or at least in portions in the housing, in such a way that the sheet-metal shield projects at least in portions into the opening and, with the further outer wall, electrically contacts the second inner wall of the ring.

The advantageous result is to make possible particularly simple production of the plug connector system, to bring about a particularly low electrical contact resistance, and to create the possibility of preventing contact corrosion.

The fact that the ring is pressed into the opening advantageously brings about particularly durable seating of the ring in the opening. A particularly large contact area between the ring and the first inner surface of the opening is furthermore created.

BRIEF DESCRIPTION OF THE DRAWINGS

Further features and advantages of the present invention will be apparent to one skilled in the art from the description below of exemplifying embodiments with reference to the figures, which are nevertheless not to be construed as limiting the present invention.

DETAILED DESCRIPTION OF EXAMPLE EMBODIMENTS

Figure 1:
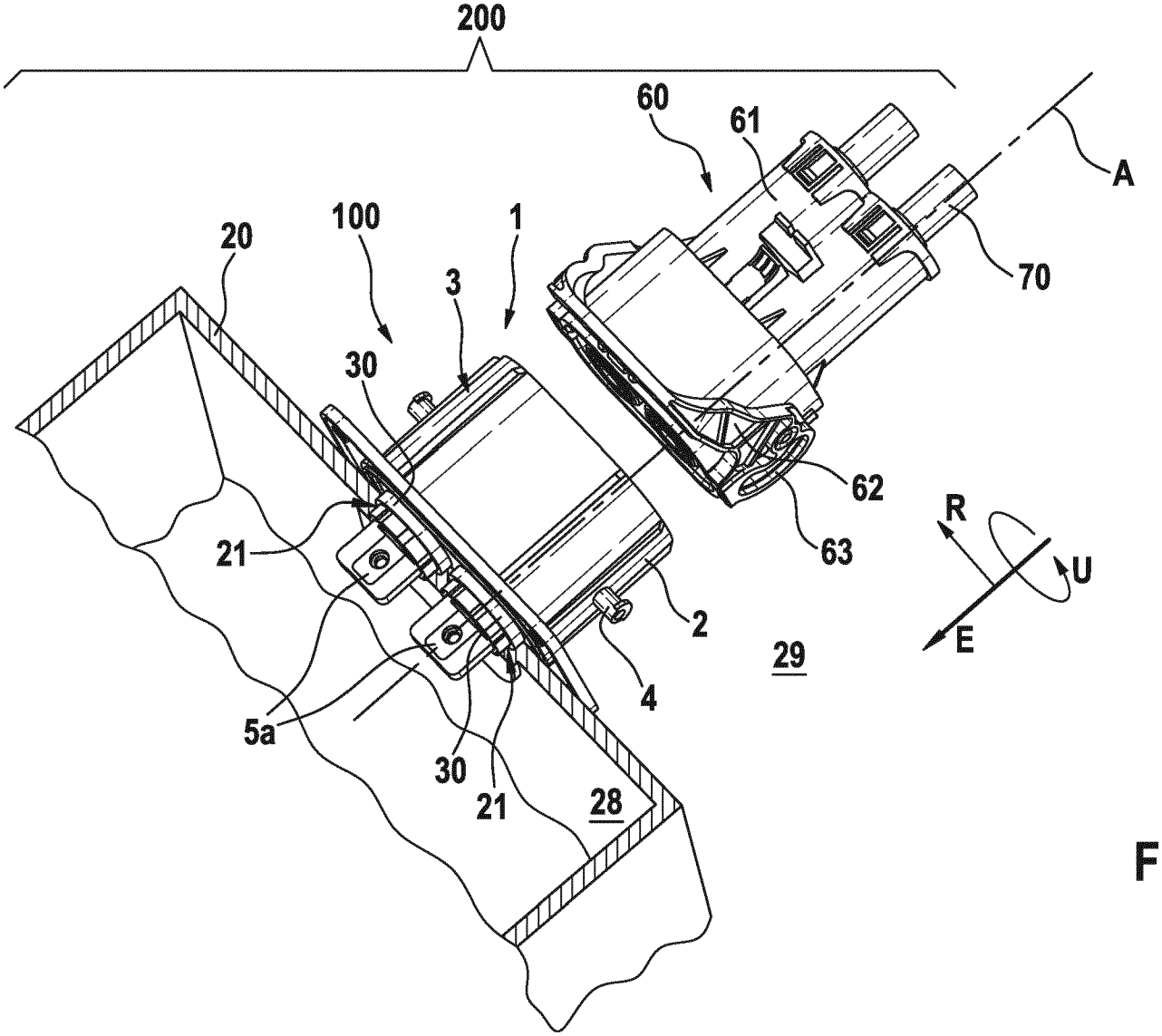
FIG. 1 is a perspective and partly sectioned depiction of a plug connector assemblage in the non-plug-assembled state in accordance with an example embodiment of the present invention.

FIG. 1 is, by way of example, a partly sectioned perspective depiction of a plug connector assemblage 200 in accordance with an example embodiment of the present invention, in the non-plug-assembled state. Plug connector assemblage 200 is constituted from a plug connector system 100 and a counterpart plug connector 60 which can be inserted in an insertion direction E onto or into a plug connector 1 of plug connector system 100.

All that is depicted of plug connector 1 here is a plug connector housing 2 having an outer wall 3. Two studs 4 facing away from each other project from plug connector housing 2 in a radial direction R transversely to an axial direction A that here extends parallel to insertion direction E. A circumferential direction U extends around axial direction A.

Counterpart plug connector 60 has a counterpart plug connector housing 61 on which a lever 62 is disposed in rotatably mounted fashion. Lever 62 has on both sides, in the region of its shaft, a respective gate 63 into which a respective stud 4 of plug connector 1 can engage upon plug-assembly of counterpart plug connector 60 with plug connector 1 in insertion direction E. By rotating lever 62 it is thus possible to convert the rotary motion into a plugging motion in insertion direction E, and thus to reduce the force that an installer needs to apply for plug assembly.

Two electrical leads 70 project from counterpart plug connector 60 oppositely to insertion direction E. In the interior of counterpart plug connector 60, an inner conductor 71 (not visible here) of lead 70 is connected to a contacting element 78 (not visible here) for each lead 70. This contacting element 78 is embodied suitably for contacting a corresponding contact element 5 (not visible here) of plug connector 1 (see e.g. FIG. 5).

Plug connector system 100 has:

the aforementioned plug connector 1, which here has, for example, a plug connector housing 2 made of plastic;

a housing 20 on which plug connector 1 is installed, e.g. inserted, and then bolted on or fastened releasably or nonreleasably by way of a riveted connection or an adhesively bonded or welded connection.

Housing 20 is merely indicated here, and is shown in section to allow better depiction of the further components or elements of plug connector system 100. Housing 20 can be embodied here, for example, from aluminum or an aluminum alloy.

In the exemplifying embodiment, housing 20 has two openings 21 each having a first inner wall 22. It is also possible, however, for only exactly one opening 21 to be provided in housing 20; or more than two openings 21 can be provided.

Housing 20 has an interior 28 in which further components, e.g. a circuit board, a control device, a data processing module, electrical terminals of an inverter, etc., can be disposed, interior 28 of housing 20 preferably being electrically shielded with respect to an external environment 29 of the housing. Distal first ends 5*a* of two contact pins 5 (see FIGS. 3 to 5), which each engage through one of the two openings 21 and can be electrically connected or contacted at a second distal end 5*b* (see FIGS. 4 and 5) respectively to one of electrical leads 70, also project into interior 28 of housing 20. Contact pins 5 can be connected, in interior 28 of housing 20, for example to electrical terminals for data leads or high-current applications. They can have, for instance, a cross section of at least 1 $mm^2$ or at least 10 $mm^2$ or at least 20 $mm^2$ in order to be able to transfer currents of at least 1 A or at least 10 A or at least 50 A.

Figure 3:
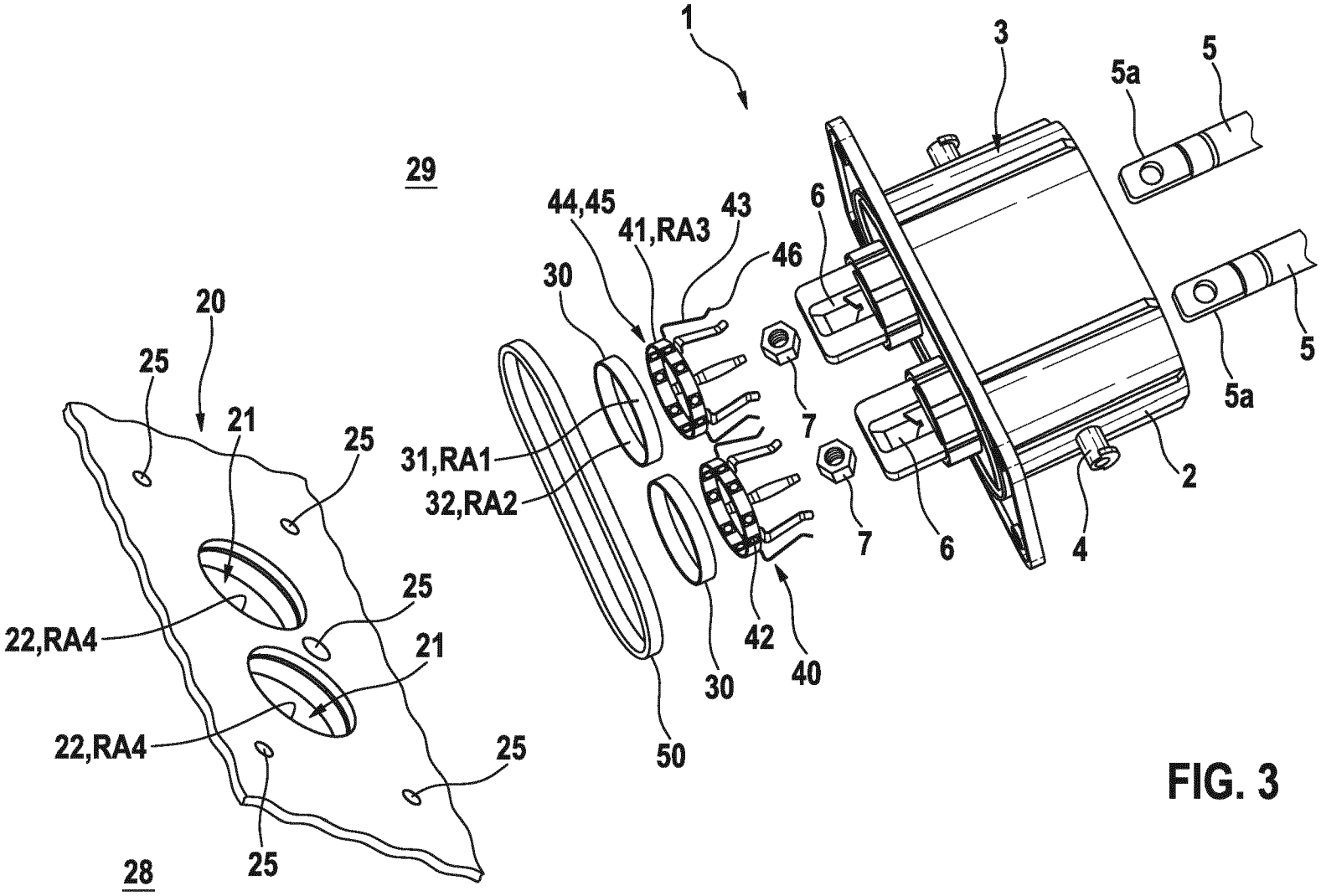
FIG. 3 is a perspective view of an exploded depiction of the plug connector system of FIG. 1.
Figure 4A:
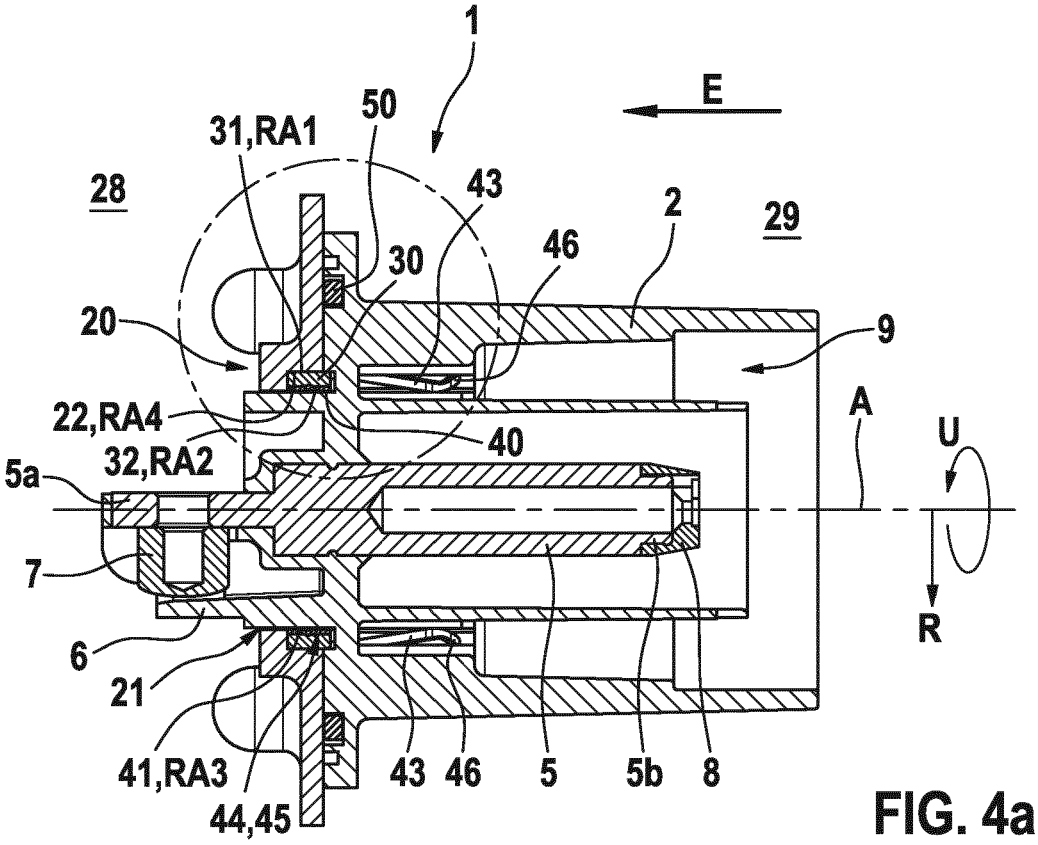
FIG. 4*a* is a cross section through the plug connector system of FIG. 1.
Figure 4B:
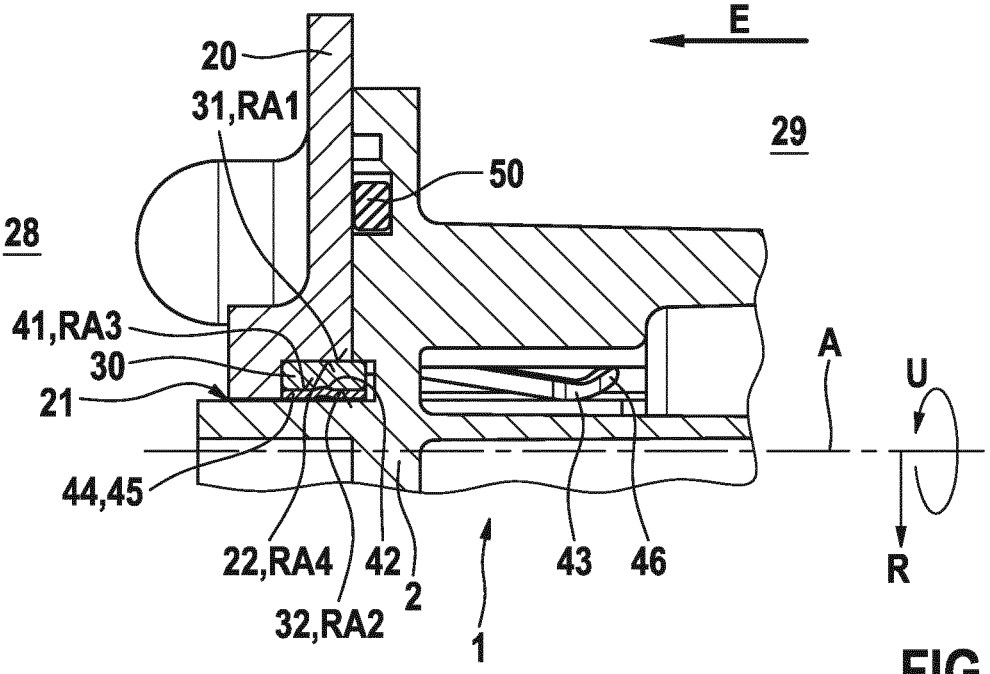
FIG. 4*b* is an enlarged detail of FIG. 4*a*.
Figure 5:
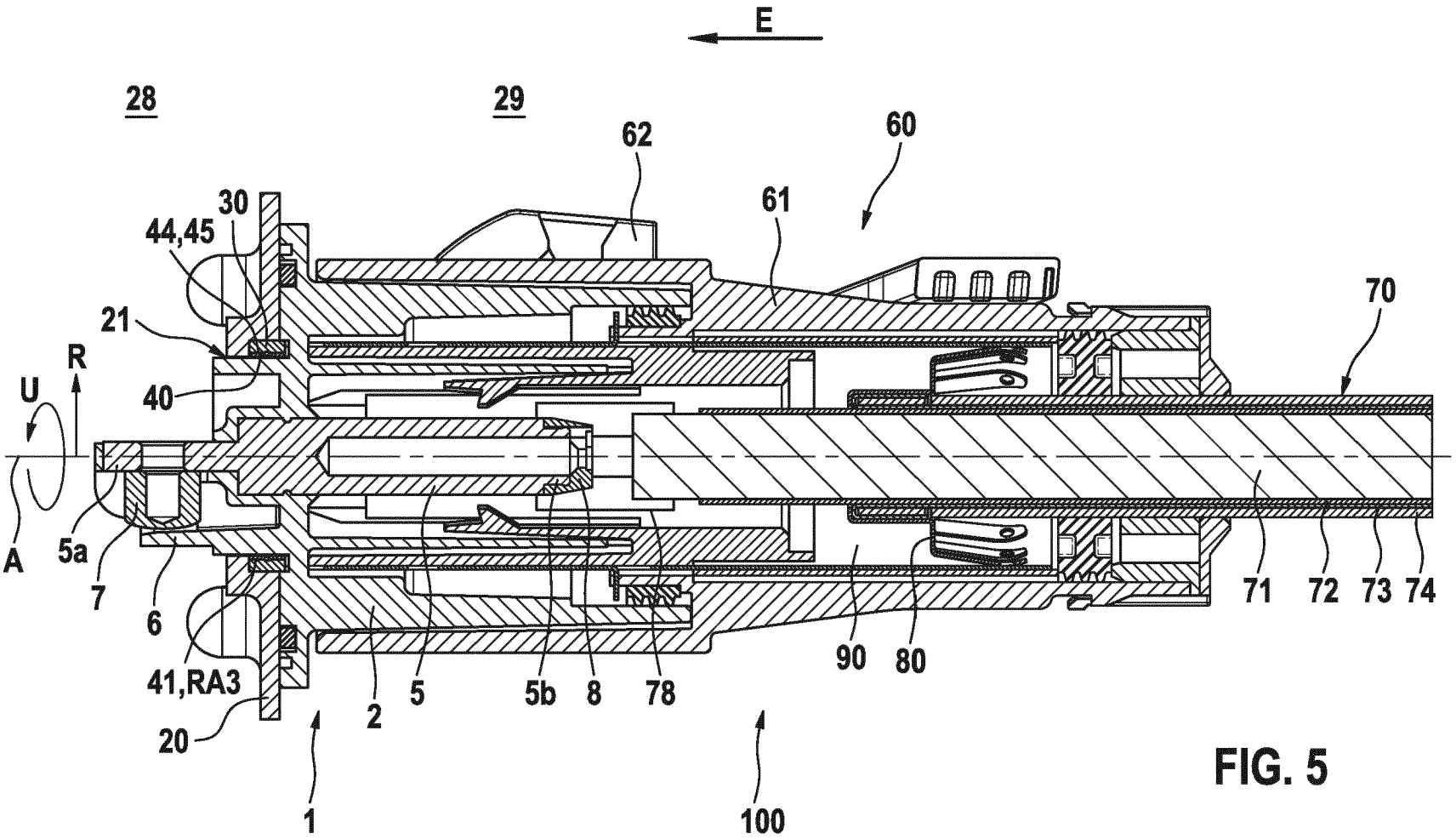
FIG. 5 is a cross section through the plug connector assemblage of FIG. 1 in the plug-assembled state.

Plug connector 1 has a sheet-metal shield 40 (not visible in this Figure) that projects at least in portions into opening 21 (see FIGS. 3 to 5). Disposed in opening 21 is a ring 30 that, with an outer wall 31 of ring 30, electrically contacts first inner wall 22 of opening 21. Sheet-metal shield 40 (not visible here) electrically contacts, with a further outer wall 41 of sheet-metal shield 40, a second inner wall 32 of ring 30. Continuous shielding from housing 20 to sheet-metal shield 40 is thereby ensured. This shielding can then be embodied uninterruptedly by an electrical connection of the sheet-metal shield to a counterpart plug connector sheet-metal shield 90 (see FIG. 5) and from there to a shielding conductor 73 of lead 70; what exists here, for instance, is a single-wire shield or single-lead shield, and not a collective shield. Contact pins 5 are each individually shielded by a sheet-metal shield 40.

Ring 30 is embodied here, by way of example, as a press-in part. It can be disposed in or pressed into opening 21, for instance, by nonpositive or frictional engagement, and as a result can exhibit a large contact area with respect to first inner wall 22 of opening 21, thus resulting in a low electrical contact resistance.

Ring 30 can be embodied, for instance, from steel or stainless steel. Housing 20 or first inner wall 22 of opening 21 can be embodied, for instance, from aluminum or an aluminum alloy. The use of this material pairing reduces the risk of contact corrosion. The electrical contact resistance thus remains low over the service life.

An average first roughness RA1 of outer wall 31 of ring 30 is equal to less than 1.0 μm, preferably less than 0.5 μm, particularly preferably less than 0.35 μm, and very particularly preferably less than 0.3 μm. Outer wall 31 of ring 30 is thus very smooth.

First inner wall 22 of opening 21 has, for example, before installation of ring 30, an average fourth roughness RA4 that is equal to more than 10 μm or is equal to between 10 μm and 50 μm or is equal to between 15 μm and 30 μm. For example, inner wall 22 of opening 21 is constituted directly from the casting of the housing, i.e. without machining.

When ring 30, with its smooth outer wall 31 and its hard material, is then pressed into opening 21, it shaves off or abrades off all the "peaks" on first inner wall 22 of opening 21, and thus also any nonconductive surface layer such as oxide layers or greases or oils or contaminants. The result is to bring about a particularly large contact area, and thus a particularly low and permanently low contact resistance.

Figure 2:
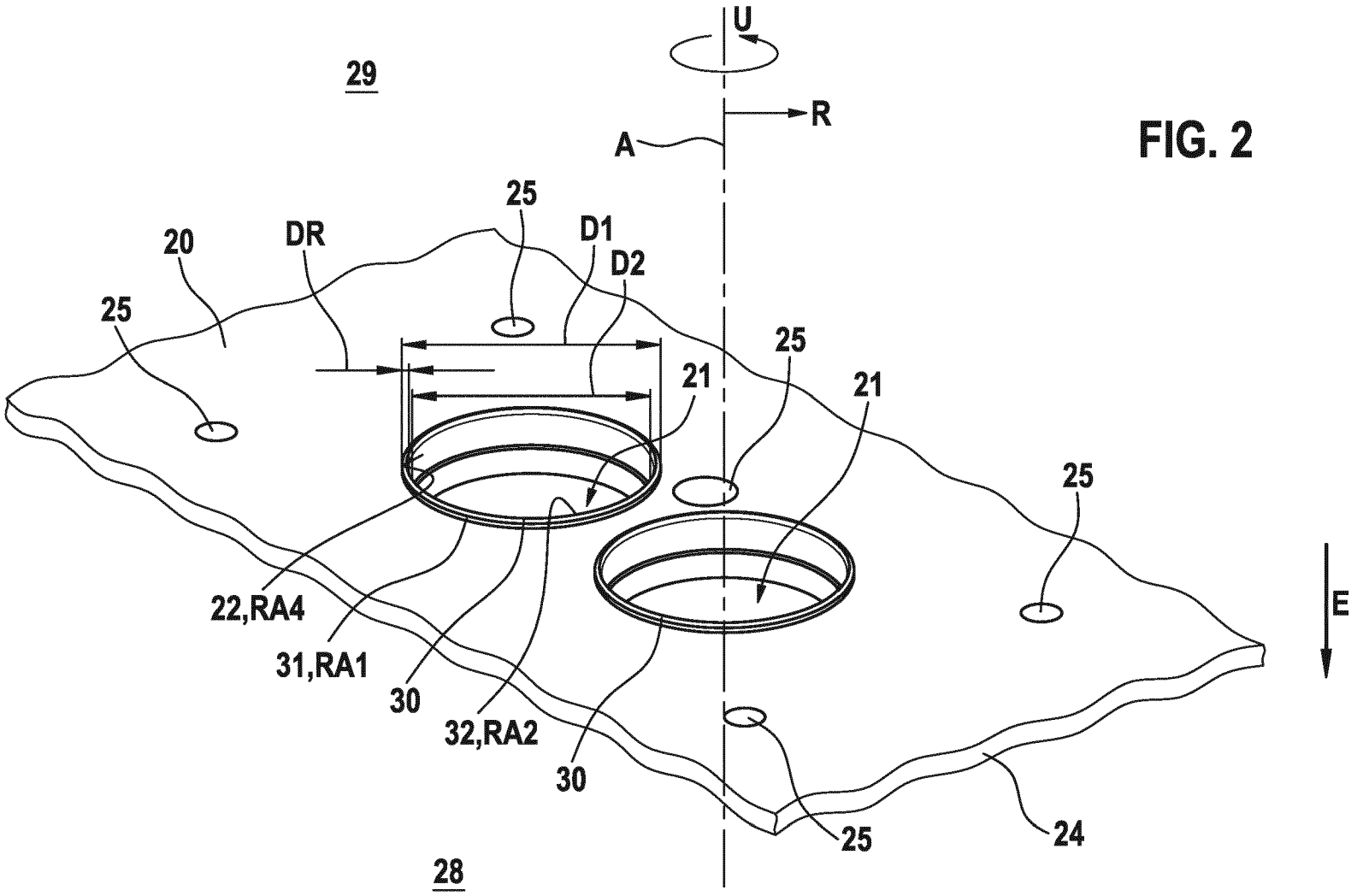
FIG. 2 is a perspective view of a detail of a housing of the plug connector system of the plug connector assemblage of FIG. 1.

FIG. 2 is a perspective view of a detail of housing 20 of plug connector system 100 of plug connector assemblage 200 of FIG. 1. Disposed in the housing, around the two openings 21 and between the two openings 21, are a total of five fastening openings 25 onto or into which plug connector housing 2 can be fastened, for example via a threaded connection or rivets.

Housing 20 has the two openings 21 in one housing wall 24. Housing wall 24 is penetrated in each case completely, in the manner of a channel, at the locations of the two openings. The rim of openings 21, however (embodied here, merely by way of example, circularly), is embodied in two steps when considered along insertion direction E or axial direction A. In other words, viewed from external environment 29, an opening 21 here firstly has a first diameter D1. The diameter of opening 21 then decreases slightly, for instance by an amount equal to a ring thickness DR of ring 30, to a second diameter D2. The ring thickness can be, for instance, in a range between 100 μm and 3 mm, preferably between 500 μm and 1.5 mm. The result is to create in opening 21 a pedestal on which ring 30, inserted or pressed into opening 21 or disposed in opening 21, rests. This makes possible particularly simple installation of ring 30 in opening 21, since ring 30 cannot fall into interior 28 of housing 20. A third diameter D3 (not depicted here), constituting an outside diameter of ring 30, can be, for instance at room temperature (in particular under light pressure), identical in size to first diameter D1 of opening 21, or it can be, at room temperature, slightly larger than first diameter D1 of opening 21, for example 1 μm to 1000 μm larger, preferably 10 μm to 500 μm larger, and very particularly preferably 20 μm to 250 μm larger. Ring 30 can thus be held by a press fit in opening 21.

This FIG. 2 clearly illustrates outer wall 31 and second inner wall 32 of ring 30, as well as first inner wall 22 of opening 21.

FIG. 3 is a perspective exploded view of plug connector system 100 of FIG. 1. Contact pins 5 here have not yet been inserted into plug connector housing 2. Two receptacles 6, each for one fastening element 7, are embodied at an end of plug connector housing 2 which faces toward interior 28 of housing 20.

Fastening element 7 is depicted here by way of example as a threaded nut. Fastening element 7 is inserted into receptacle 6; contact pin 5 is then slid with its first distal end 5*a* into plug connector housing 2. An electrical terminal of, for instance, an inverter, or another electrical contact from interior of 28 of housing 20, can be bolted onto fastening element 7 when plug connector 1 is disposed on housing 20.

A sealing element 50 in the form of a sealing ring is also disposed between housing 20 and plug connector housing 2. Penetration of fluid media from external environment 29 into interior 28 of housing 20 can thereby be prevented. The two rings 30, initially constituting parts separate from housing 20, are inserted into the two openings 21 of housing 20 or installed therein, for instance pressed thereinto. It is understood that it is also possible for only a single opening 21, or more than two openings 21, to be provided in housing 20.

Lastly, FIG. 3 depicts two sheet-metal shields 40, one sheet-metal shield 40 for each contact pin 5. Sheet-metal shield 40 here has, merely by way of example, the shape of a crown. In other words, it has an annularly continuous base element 44. Disposed on base element 44 is a plurality of, for instance, eight arms 43 that, looking oppositely from insertion direction E, extend from base element 44 and each have a free end 46. The result of the plurality of arms 43 is on the one hand to ensure contacting redundancy, since shielding with respect to counterpart plug sheet-metal shield 90 (FIG. 5) is ensured even in the event of failure of one arm 43. At the same time, the plurality of arms 43 results in a plurality of parallel current paths to counterpart plug sheet-metal shield 90, so that in accordance with Kirchhoff's law, the electrical contact resistance decreases as compared with only a single contact point.

In a state installed in plug connector housing 2 and in plug connector system 100, base element 44 projects at least in portions into the associated opening 21 of housing 20. This can be, for instance, portion 45, for instance the entire base element 44, or a front portion (considered in insertion direction E) of base element 44. Base element 44 has further outer wall 41, or a further outer wall with which sheet-metal shield 40 is contacted to second inner wall 32 of ring 30. Contact points 42 are embodied on further outer wall 41 of sheet-metal shield 40, for example by a boss that protrudes radially outward from further outer wall 41. Contacting with respect to second outer wall 32 of ring 30 can thereby be ensured particularly reliably. In addition, the electrical contact resistance with respect to ring 30 can be decreased by the plurality of contact points 42, since what is produced here is a kind of parallel circuit having a number of current paths that corresponds to the number of contact points 42 (Kirchhoff's law).

Further outer wall 41 of sheet-metal shield 40 can have, for instance, a coating (e.g., resulting from electrodeposition or a CVD or PVD process). A coating of this kind can, for instance, reduce an electrical contact resistance. It can also serve as a kind of corrosion protection since, for instance, the material of sheet-metal shield 40 could tarnish in contact with air. A coating can, for instance, also bring about hardening of the surface and can thus protect the surface upon insertion. Lastly, a coating of this kind can bring about a reduction in insertion force. A coating of this kind can encompass, for instance, in particular predominantly, a material that is selected from the group: silver, gold, platinum, palladium, nickel, tin. Such a coating can be embodied, for instance, in multiple plies. For instance, the material of sheet-metal shield 40 can have a layer of nickel applied onto it, and a layer of silver onto that.

In principle, alternatively or additionally, ring 30 can also have a coating of this kind on outer wall 31 and/or on second outer wall 32.

Second outer wall 32 of ring 30 is preferably embodied to be smooth. It can have, for instance, an average second roughness RA2 that is less than 1.0 μm or less than 0.5 μm or less than 0.35 μm or even less than 0.3 μm. This minimizes the risk of scratching a surface of shielding panel 40 upon insertion of sheet-metal shield 40 into opening 21.

An average third roughness RA3 of further outer wall 41 of sheet-metal shield 40 can be, for example, less than 1.0 μm or less than 0.5 μm or less than 0.35 μm or less than 0.3 μm. The insertion force upon insertion into opening 21, or upon contacting of second inner wall 32 of ring 30, can thereby be reduced. The risk of damaging the surface of sheet-metal shield 40 can furthermore thereby be reduced.

FIG. 4*a* is a cross section through plug connector system 100 of FIG. 1. It is apparent that, looking radially from outside in the region of opening 21, firstly housing 20, then ring 30, and then sheet-metal shield 40 follow one another and are in electrical contact. Also clearly apparent, looking in an axial direction A, is the pedestal in housing 20 in the region of the rim of opening 21.

Contact pin 5 has, at its second distal end 5*b*, a contact guard 8 that is constituted, for instance, in the manner of a cap made of an electrically nonconductive plastic. This can be important, for instance, for high-current or high-power or high-voltage applications. Plug connector housing 2 has, located radially externally, an insertion opening 9 for counterpart plug connector 60.

FIG. 4*b* is an enlarged detail of FIG. 4*a*, counterpart plug connector 60 here being inserted into plug connector 1. This is apparent from counterpart plug connector sheet-metal shield 90, which projects into insertion opening 9 and contacts an inner surface of arm 43 of sheet-metal shield 40.

FIG. 5 is a cross section through the plug connector assemblage of FIG. 1 in the plug-assembled state.

It is evident that electrical lead 70 has an inner conductor 71 that, when looking radially outward, is surrounded by an inner insulator 72 that in turn is surrounded by a shielding conductor 73 that, lastly, is surrounded externally by an outer insulator 74.

The Figure schematically depicts the manner in which a contacting element 78 establishes the electrical connection between contact pin 5 (which can also be embodied as a contact blade or a contact element, etc.) and inner conductor 71 of electrical lead 70.

Counterpart plug connector sheet-metal shield 90 is in turn connected, by way of a crown-like connecting element 80, to shielding conductor 73 of electrical lead 70.

Plug connector assemblage 200 is thus radially externally electrically shielded everywhere when viewed in axial direction A or along the current path, and thus exhibits particularly good electromagnetic compatibility (EMC).

What is claimed is:

1. A plug connector system comprising:

a plug connector that includes (1) at least one electrical terminal, (2) a plug connector housing that houses the at least one electrical terminal, and (3) a sheet-metal shield;

a housing on which the plug connector is installed, the housing having an opening having a first inner wall, wherein at least a portion of the sheet-metal shield projects into the opening; and a ring having a second inner wall and being disposed in the opening;

wherein an outer wall of the ring electrically contacts the first inner wall of the opening, and an outer wall of the sheet-metal shield electrically contacts the second inner wall of the ring.

2. The plug connector system as recited in claim 1, wherein the ring is fastened in the opening by nonpositive or frictional engagement, or the ring is pressed into the opening.

3. The plug connector system as recited in claim 1, wherein an average roughness of the outer wall of the ring is equal to less than 1.0 μm.

4. The plug connector system as recited in claim 1, wherein an average roughness of the second inner wall of the ring is equal to less than 1.0 μm.

5. The plug connector system as recited in claim 1, wherein an average roughness of the outer wall of the sheet-metal shield is equal to less than 1.0 μm.

6. The plug connector system as recited in claim 1, wherein the first inner wall of the opening is at least predominantly formed of aluminum.

7. The plug connector system as recited in claim 1, wherein the first inner wall of the opening has, before installation of the ring, an average roughness that is equal to more than 10 μm .

8. The plug connector system as recited in claim 1, wherein the portion of the sheet-metal shield which projects into the opening of the housing includes copper.

9. The plug connector system as recited in claim 1, wherein the ring is constituted from a material that has a standard electrode potential that is between (1) a standard electrode potential of the first inner wall of the opening of the housing and (2) a standard electrode potential of a portion of the sheet-metal shield that projects into the opening.

10. The plug connector system as recited in claim 1, wherein the ring is at least predominantly formed of steel or stainless steel.

11. The plug connector system as recited in claim 1, wherein the first inner wall of the opening is rougher than the outer wall of the ring.

12. The plug connector system as recited in claim 1, wherein respective standard electrode potentials of each of the housing, the ring, and the sheet-metal shield differ from one another, and the respective standard electrode potential of the ring is between the respective standard electrode potentials of the housing and the sheet-metal shield.

13. The plug connector system as recited in claim 1, wherein the sheet-metal shield is coated with a coating that is formed of a plurality of plies, and standard electrode potentials of the plies gradually change from a first one of the plies that is nearest of the plies to the sheet-metal shield to another one of the plies that is farthest of the plies from the sheet-metal shield such that (1) the standard electrode potential of the first one of the plies has a first value that is, of the standard electrode potential values of the plies, most similar to a standard electrode potential value of the sheet-metal shield and (2) the standard electrode potential of the another one of the plies has a second value that is, of the standard electrode potential values of the plies, most different from the standard electrode potential value of the sheet-metal shield.

14. The plug connector system as recited in claim 13, wherein the plies are formed predominantly of materials selected from the group consisting of: silver, gold, platinum, palladium, nickel, and tin.

15. The plug connector system as recited in claim 1, the sheet-metal shield is formed of a ring base that is at least partially within the ring and a plurality of arms extending away from the ring base and the ring.

16. The plug connector system as recited in claim 1, wherein the sheet-metal shield extends from inside the plug connector housing into the ring outside of the plug connector housing.

17. The plug connector system as recited in claim 1, wherein the outer wall of the sheet-metal shield includes a plurality of radial protrusions within the ring and contacting the second inner wall of the ring.

18. The plug connector system as recited in claim 1, wherein the at least one electrical terminal projects out of the plug connector housing in a direction away from the housing on which the plug connector is installed.

19. The plug connector system as recited in claim 1, wherein the ring is evenly round and shaped as a circle.

20. The plug connector system as recited in claim 1, wherein the outer wall of the ring physically directly contacts the first inner wall of the opening.

21. The plug connector system as recited in claim 1, wherein the first inner wall of the opening is at least predominantly formed of aluminum, and the ring is at least predominantly formed of steel or stainless steel.

22. The plug connector system as recited in claim 1, wherein the outer wall of the ring has an outer diameter that is equal to or greater than a largest inner diameter of the first inner wall of the opening.

23. The plug connector system as recited in claim 1, wherein the first inner wall of the opening, the ring, and the sheet-metal shield are arranged without any gaps between them in a radial direction.

24. A method for manufacturing a plug connector system, the method comprising the following steps:

furnishing a housing having an opening, the opening having a first inner wall;

furnishing a ring having an outer wall and a second inner wall;

disposing the ring in the opening in such a way that the outer wall of the ring electrically contacts the first inner wall of the opening;

furnishing a plug connector that includes (1) at least one electrical terminal, (2) a plug connector housing that houses the at least one electrical terminal, and (3) a sheet-metal shield;

disposing the plug connector on the housing in such a way that:

at least a portion of the sheet-metal shield projects into the opening; and an outer wall of the sheet-metal shield electrically contacts the second inner wall of the ring.

25. The method as recited in claim 24, wherein the ring is pressed into the opening.

26. The method as recited in claim 24, wherein the first inner wall of the opening is rougher than the outer wall of the ring, the disposing of the ring in the opening includes inserting the ring into the opening, and the insertion causes the ring to shave off peaks formed by the roughness of the first inner wall of the opening.

27. The method as recited in claim 24, wherein the disposing of the ring in the opening is performed such that the ring is pre-mounted in the opening prior to the plug connector being mounted in the opening of the housing in the disposing step.

* * * * *